United States Patent [19]

Tutomu et al.

[11] 4,384,668

[45] May 24, 1983

[54] SAFETY SYSTEM FOR PNEUMATIC IMPACT TOOL

[75] Inventors: Sato Tutomu; Takatsuru Mitsuhiro; Matsumoto Hitoshi, all of Takasaki, Japan

[73] Assignee: Max Co., Ltd., Tokyo, Japan

[21] Appl. No.: 201,415

[22] PCT Filed: Feb. 28, 1980

[86] PCT No.: PCT/JP80/00035

§ 371 Date: Oct. 28, 1980

§ 102(e) Date: Oct. 23, 1980

[87] PCT Pub. No.: WO80/01773

PCT Pub. Date: Sep. 4, 1980

[30] Foreign Application Priority Data

Feb. 28, 1979 [JP] Japan ..... 54-023108

[51] Int. Cl.[3] ..... B25C 104

[52] U.S. Cl. ..... 227/8; 173/169

[58] Field of Search ..... 173/169; 227/8, 130, 227/120, 156

[56] References Cited

U.S. PATENT DOCUMENTS

| | | | |
|---|---|---|---|
| 4,106,750 | 8/1978 | Karden | 173/169 X |
| 4,165,676 | 8/1979 | Siegmann | 173/169 X |
| 4,194,664 | 3/1980 | Siegmann | 227/8 |

FOREIGN PATENT DOCUMENTS

| | | |
|---|---|---|
| 44-2666 | 2/1969 | Japan . |
| 46-26236 | 9/1971 | Japan . |

*Primary Examiner*—Paul A. Bell

[57] ABSTRACT

Disclosed is a safety system for use in a pneumatic impact tool for driving a fastener, for preventing accident or injury to personal body. Particularly, the injury to personal body, which often occurs at the instant of connection of the tool to a compressed air source, is completely eliminated. The safety system is automatically turned into operative state when the tool is disconnected from the compressed air source, and the fastener driving work cannot be started unless the safety system is turned into inoperative state by a manual operation.

8 Claims, 13 Drawing Figures

SAFETY SYSTEM FOR PNEUMATIC IMPACT TOOL

DESCRIPTION

TECHNICAL FIELD

The present invention relates to a pneumatic type impact tool in which an impact piston-cylinder mechanism is driven by compressed air, while a part of the compressed air is used for a controlling purpose, such that a rod-shaped or blade-shaped driver rigidly connected to the impact piston drives fasteners such as nails, staple or the like one from a magazine by one from a nose. More particularly, the invention is concerned with a safety system for pneumatic impact tool of the type described, capable of avoiding injury to the personal body by mis-shooting of the fastener.

BACKGROUND ART

There have been proposed various types of pneumatic nail drivers as a kind of pneumatic impact tool driven and controlled by compressed air containing lubricating oil. One of the known nail driver has a grip formed as a part of the housing, for an easier handling and transportation by the operator. The housing contains a piston-cylinder mechanism, head valve for starting or stopping the supply of compressed air to the impact piston-cylinder mechanism, and a manually operable trigger valve for controlling the head valve. More specifically, the trigger valve is switched by a manual operation of a trigger lever, so that the head valve is switched to the position for supplying the compressed air. In consequence, the upper chamber of the impact cylinder formed at the top dead center of the impact piston is communicated with a compressed air source through an air hose, so that the compressed air is instantaneously supplied from a compressed air chamber into the upper chamber in the impact cylinder, so that the pressure of the compressed air acts on the impact piston to instantaneously drive the impact piston to the bottom dead center of the impact piston thereby to drive the nail into an object.

Another type of known pneumatic nail driver has a rod-shaped driver adapted to reciprocatingly move in a nose. A trigger safety arm mechanically connected to the trigger lever is movable reciprocatingly in the longitudinal direction of the nose. As the trigger lever is manually actuated while pressing the contact surface of the trigger safety arm against the object surface, the impact piston is moved to drive the nail into the object surface.

Each of such known pneumatic nail drivers incorporates a head valve piston adapted to move between the top dead center and the bottom dead center by the difference of the total pressure of air acting on the upper and lower surfaces, and a valve spring adapted for assisting the resetting movement of the head valve piston. The valve spring usually keeps the head valve piston stationary at the bottom dead center, so as to disconnect the upper chamber of the impact cylinder from the compressed air storage chamber. Therefore, when there is no time lag of the application of compressed air on the upper surface of the head valve piston in relation to the application of compressed air to the lower surface of the same, the compressed air is not allowed to flow into the upper chamber of the impact cylinder even at the instant at which the compressed air is supplied to the compressed air storage chamber, so that the accidental discharge of the impact piston (referred to as initial discharge of the impact piston, hereinunder) is avoided. However, in the pneumatic nail driver to which the invention pertains, a part of the lower surface of the head valve piston is directly exposed to the compressed air storage chamber, while, the compressed air supplied from the compressed air storage chamber via a control air passage including a trigger valve generating a throttling effect is applied to the upper surface of the head valve piston. As a result of this arrangement, at the instant of supply of the compressed air to the compressed air storage chamber, the compressed air acts on the lower side of the head valve piston earlier than on the upper side of the same. In consequence, the force of the compressed air acting on the lower side of the head valve piston drives the latter toward the top dead center, overcoming the force of the valve spring, so that the upper chamber of the impact cylinder is brought into communication with the compressed air storage chamber. In consequence, the initial discharge of the impact piston is caused undesirably at the instant at which the compressed air storage chamber is connected to the compressed air source.

In this case, the aforementioned valve spring performs no substantial function.

Further, as stated before as to function of the valve spring, the lubricating oil is atomized and contained by the compressed air. This lubricating oil increases its viscosity when the nail driver is used at a low temperature, so as to hinder the correct operation of the valve spring in the head valve. Thus, it is often experienced that, at the time of restarting of the nail driver after a suspension of the use, the valve spring has not completely reset the head valve piston, so that the latter is positioned intermediate between the top and bottom dead centers to maintain the upper chamber of the impact cylinder in communication with the compressed air storage chamber. The undesirable initial discharge of the impact piston takes place also for this reason.

Generally, when the pneumatic nail driver is connected to a compressed air source, the operator is not ready for the work, and nose of the nail driver is often directed toward a part of the personal body, particularly the foot. If the initial discharge of the impact piston takes place in such a state, the operator or any person in his vicinity will be injured accidentally by the nail discharged from the nail driver.

The trigger safety arm incorporated in the second type of known nail driver functions as a safety mechanism which prevents, in connection with the manual operation of the trigger lever, the mis-shooting during the nail driving work. Thus, this mechanism is quite invalid for preventing the mis-discharge which may occur when the compressed air chamber is connected to the compressed air source in the preparation of the work.

When the operator who has completed the work at one place moves to the near another place, he holds the grip of the nail driver by a single hand and, moreover, pulling the trigger lever in order to disolve the unbalance of weight of the nail driver, without disconnecting the air hose leading from the compressed air source, from the nail driver. Therefore, if the contact surface of the trigger safety arm is happened to contact something during transportation of the nail driver and the trigger safety arm is caused to move in the longitudinal direction of the nose, the mis-discharge will take place possibly resulting in an injury of the operator's foot.

It is often necessary that, due to relationship between one and another work places, the air hose leading from the compressed air source is temporarily disconnected from the nail driver. The aforementioned valve spring of the head valve and the trigger safety arm are invalid or insufficient for completely eliminating the mis-discharge which may take place when the hose is connected again to the nail driver.

Further, the trigger safety arm often fails to be reset to the operative position after the stop of the nail driving work. If the operator pulls the trigger lever in such a state for transportation of the nail driver, the mis-discharge will take place to injure the operator.

DISCLOSURE OF THE INVENTION

It is, therefore, an object of the invention to automatically prevent the injury to personal body by a fastener discharged as a result of an initial discharge of the impact piston which tends to occur at the instant at which the pneumatic impact tool is connected to the compressed air source.

It is another object of the invention to make it possible to manually operate the safety system, when the pneumatic impact tool is transported without being disconnected from the compressed air source.

To these ends, according to the invention, there is provided a safety system incorporated in the pneumatic impact tool and capable of being automatically set in an operative state as the pneumatic impact tool is disconnected from the compressed air source.

Namely, according to an aspect of the invention, there is provided a safety valve incorporated in a pneumatic impact tool, the impact tool having an impact piston slidably received by an impact cylinder, and rigidly connected to a driver adapted to strike a fastener, the impact cylinder and the impact piston defining in cooperation an upper chamber of the impact cylinder in the top dead center of the impact piston; a compressed air storage chamber adapted to be supplied with the compressed air or to discharge the compressed air in accordance with the connection of the pneumatic impact tool to and the disconnection thereof from the compressed air source; a head valve cylinder disposed between the upper chamber of the impact cyinder and the compressed air storage chamber, and accommodating a head valve piston; a differential pressure type head valve adapted to interrupt the communication between the upper chamber of the impact cylinder and the compressed air storage chamber when the head valve piston is held stationary at the bottom dead center, and to establish the above-mentioned communication during the movement of the head valve piston from the bottom dead center to the top dead center, so that the movement of the head valve piston between the top dead center and the bottom dead center takes place as a result of change of air pressure in the control air passage which interconnects the compressed air storage chamber to a control chamber defined within the head valve, the pressure in the control air passage being under the control of a manually operable trigger valve; the safety system comprising: a first control air passage always in communication with said control chamber; a second control air pappage having a trigger valve and adapted to maintain the communication with the compressed air storage chamber when the trigger valve is not being operated manually; and a self-holding type safety valve disposed between the first and the second control air passages and including a safety valve cylinder accommodating a valve piston provided with a manually operable stem and a valve spring, the safety valve including a mis-discharge prevention air introduction port which always maintains communication with the compressed air storage chamber, a first connection port which always maintains communication with the first control air passage and a second connection port which always maintains communication with the second control air passage; wherein, when said compressed air storage chamber is disconnected from the compressed air source, the safety valve is switched by the action of the valve spring to maintain such a state that the compressed air is supplied directly to the control chamber via the mis-discharge prevention air introduction port without being ruled by the trigger valve, and, when the compressed air storage chamber is connected to the compressed air source, such a state is maintained that the compressed air acts on the lower side of the head valve piston and, at the same time, the control chamber is charged with the compressed air; whereby, as the manually operable stem is operated, the safety valve is switched to such a state that the communication between the first control air passage and the mis-discharge prevention air introduction port is broken and the communication between the first and the second control air passages is completed to place the air pressure in the control chamber under the control of the trigger valve, this state being maintained throughout the period of driving of the fastener.

According to another aspect of the invention, there is provided a safety system incorporated in a pneumatic impact tool, the impact tool having an impact piston slidably received by an impact cylinder, and rigidly connected to a driver adapted to strike a fastener, the impact cylinder and the top dead center of the impact piston defining in cooperation an upper chamber of the impact cylinder in the impact piston; a compressed air storage chamber adapted to be supplied with the compressed air or to discharge the compressed air in accordance with the connection of the pneumatic impact tool to and the disconnection thereof from the compressed air source; a head valve cylinder disposed between the upper chamber of the impact cylinder and the compressed air storage chamber, and accommodating a head valve piston; a differential pressure type head valve adapted to interrupt the communication between the upper chamber of the impact cylinder and the compressed air storage chamber when the head valve piston is held stationary at the bottom dead center, and to establish the above-mentioned communication during the movement of the head valve piston from the bottom dead center to the top dead ceter, so that the movement of the head valve piston between the top dead center and the bottom dead center takes place as a result of change of air pressure in a control air passage which interconnects the compressed air storage chamber to a control chamber defined within the head valve, the pressure in the control air passage being under the control of a manually operable trigger valve; the safety system including a self-holding type safety cylinder device disposed in the close proximity of the head valve, the safety cylinder device including a safety cylinder and a safety piston or plunger accommodated by the safety cylinder, the safety piston or plunger being freely movable into and out of the control chamber and provided with a lock stem adapted to contact the upper side of the head valve piston at the bottom dead center to prevent the latter from moving toward the top dead center, and manually operable stem, said safety cylinder device further including a spring adapted to reset said safety piston or plunger so as to permit said lock stem to project into said control chamber, and a self-holding air introduction port always communicated with the compressed air storage chamber and adapted to supply the compressed air so as to hold the safety piston or plunger at such a position as to retract the lock stem from the control chamber; wherein, when said compressed air storage chamber is disconnected from the compressed air source, the lock stem is advanced into the control chamber by the resetting force exerted by the spring and held at the advanced position and, when the compressed air storage chamber is connected to the compressed air source, the locked state of the head valve piston is also maintained, the release of the locked state is effected by manually moving the safety piston or the plunger to the inoperative position of the safety system by a manual operation of the manually operable stem, the safety piston or plunger being held at the inoperative position of the system by the compressed air which is supplied through the self-holding air introduction port.

Thus, according to the invention, the safety system is automatically turned into operative state when the compressed air is removed from the compressed air storage chamber as a result of disconnection of latter from the compressed air souce, and the operative state of the safety system is maintained till the moment immediately before the driving of the next driving of fastener. Therefore, when the compressed air storage chamber is connected again to the compressed air source, the impact piston has been already set in the inoperative state, so that the initial discharge of the impact piston, when the compressed air is supplied to the compressed air storage chamber, is fairly avoided.

Further, the safety system operates automatically in response to the manual operation for disconnecting the compressed air storage chamber from the compressed air source, so that the next driving of the fastener is never triggered unless the safety valve piston of the safety system is manually operated. Therefore, the troublesome work for operating the safety system is eliminated and injury to the personal body due to forgetting further operation for safety, which may take place during the preparation is completely avoided.

Further, accident which may occur during the suspension of operation is avoided, because the safety system can be manually set in the operative condition whennever required.

THE BEST MODE FOR CARRYING OUT THE INVENTION

The best modes for carrying out the invention will be described with reference to the accompanied FIGS. 1 to 13.

Figure 1:
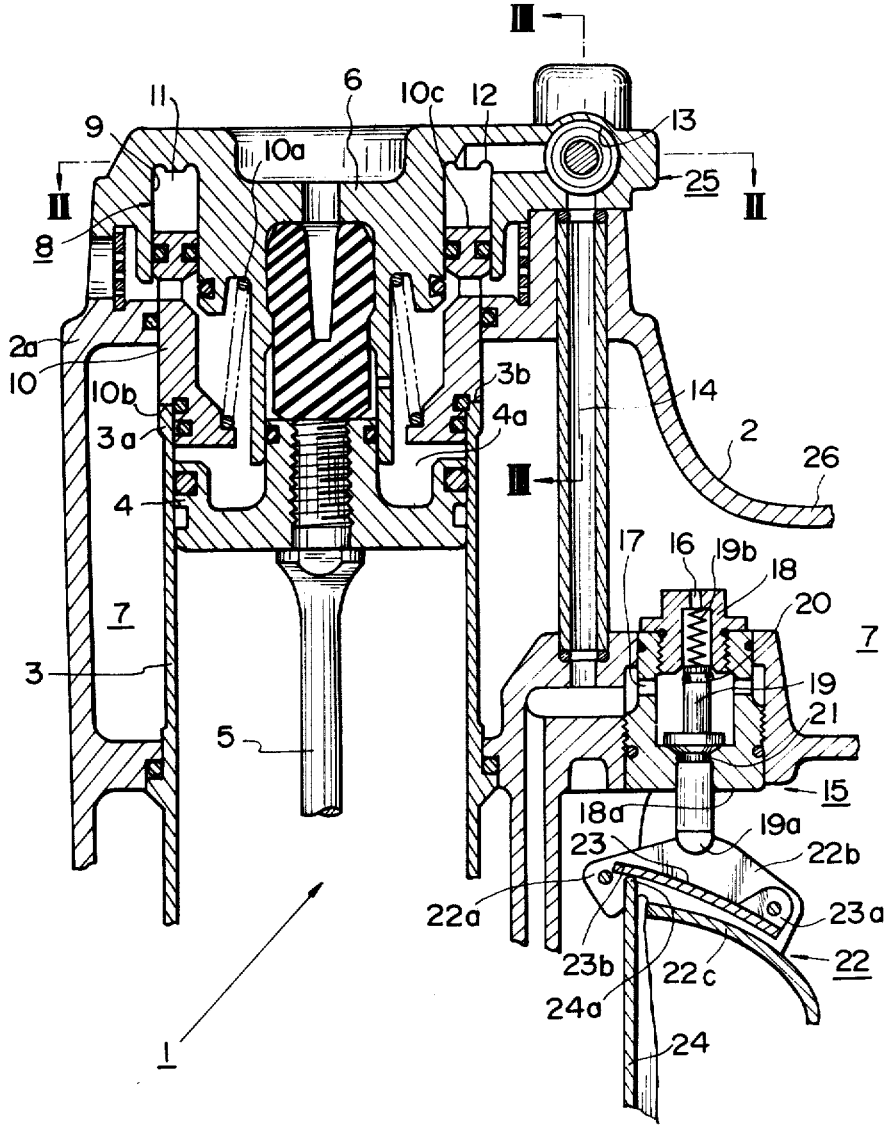
FIG. 1 is a longitudinal sectional view of an essential part of a pneumatic nail driver incorporating a safety system concerned to an embodiment of the invention.

Referring first to FIG. 1 showing a longitudinal sectional view of an essential part of a pneumatic nail driver 1 incorporating a safety system of the invention, the pneumatic nail driver 1 has an impact cylinder 3 fixed to the inside of a housing 2 and an impact piston 4 slidably mounted in the impact cylinder 3. A rod-shaped driver 5 adapted for impacting a nail (not shown) is rigidly connected to the impact piston 4. A nose is attached to the housing 2 so as to extend from the lower end (not shown) of the latter coaxially with the impact cylinder 3. The rod-shaped driver 5 is adapted to reciprocatingly move within this nose.

A housing cap 6 fitted to the housing 2 is positioned above the impact cylinder 3, so as to close the opening formed at the upper end of the housing 2. A compressed air storage chamber 7 is formed in the housing 2 so as to surround the impact cylinder 3 and to extend toward a grip 26 of the housing 2. The compressed air storage chamber 7 is adapted to be supplied with compressed air from a compressed air source (not shown) through a compressed air introduction port (not shown).

When the air hose leading from the compressed air source is disconnected from the compressed air introduction port, the compressed air storage chamber 7 is communicated with atmosphere through this port. Between the compressed air storage chamber 7 and, an upper chamber 4*a* of the impact cylinder 3 formed at the same side as the top dead center of the impact piston 4 which devides the space in the impact cylinder 3 into two chambers, disposed is a head valve 8 having a head valve cylinder 9 which is constituted by a part of the housing 2, the housing cap 6 and an upper end 3*a* of the impact cylinder 3. This head valve 8 establishes and blocks the communication between the compressed air storage chamber 7 and the upper chamber 4a of the impact cylinder 3.

The head valve 8 comprises the above-mentioned head valve cylinder 9 having a substantially annular form, a differential pressure type head valve piston 10 slidably mounted in the head valve cylinder 9 and having an annular form, and a valve spring 10a.

A slight gap (not visible in the relatively small scale drawing of FIG. 1) for permitting the compressed air in the compressed air storage chamber 7 to come in is formed between an upper face 3b of the upper end 3a of the impact cylinder 3 and a shoulder portion 10b contacting the upper face 3b. Due to the presence of this gap, the pressure of this compressed air acts on the shoulder 10b of the head valve piston 10, so that a thrust force is generated to always bias the head valve piston toward the top dead center.

Between a control chamber 11 formed at the top-dead-center side of the head valve piston 10 in the head valve 8 and the compressed air storage chamber 7, disposed are a first control air passage 12 provided in the housing cap 6, a safety valve cylinder 13 communicated with the first control air passage 12, a pipe-like second control air passage 14 communicating with the safety valve cylinder 13 and a trigger valve 15 which is in communication with the second control air passage 14. The first control air passage 12 is extremely short as compared with the second control air passage 14. In addition, the flow resistance in the first control air passage 12 is extremely small, because the latter has no element which would cause a throttling effect. These first control air passage 12, safety valve cylinder 13, second control air passage 14 and the trigger valve 15 in combination constitute a control air passage for controlling the air pressure in the control chamber 11.

The above-mentioned trigger valve 15 is adapted to be operated manually, and includes a trigger valve cylinder 18 provided with a communication port 16 communicating with the compressed air storage chamber 7, as well as a communication port 17 communicating with the second control air passage 14. The trigger valve 15 further includes a trigger valve piston 19 accomodated by the trigger valve cylinder 18. The above-mentioned communication port 16 is an element which provides a distinctive throttling effect. Partly because of the presence of this communication port 16, and partly because the second control air passage 14 has a length much greater than that of the first control air passage 12, the second control air passage 14 imposes a much greater flow resistance than the first control air passage 12. The trigger valve piston 19 is adapted to be reset to the starting position by a valve spring 19b.

The trigger valve piston 19 has a first sealing portion 20 adapted to establish and block the communication between the communication ports 16 and 17, and a second sealing portion 21 adapted to establish and block the communication between the communication port 17 and the atmosphere. The trigger valve piston 19 is provided with a manually operable stem 19a projecting from the trigger valve cylinder 18 out of the housing 2.

Between the manually operable stem 19a and the trigger valve cylinder 18, formed is a gap which permits the compressed air to flow therethrough. This manually operable stem 19a is adapted to be pushed up by means of a lever 23, during the pulling or releasing operation of the trigger lever 22 pivoted at its rotary end 22a to the housing 2, or pushed down by the valve spring 19b. The lever 23 is supported at its rotary end 23a by two side plates 22b which in combination constitute a trigger lever 22, while the free end 23b of the lever 23 is in contact with the trigger engaging end 24a of a trigger safety arm 24 disposed at the outside of the nose. Two side plates 22b of the trigger lever 22 are connected to one another by means of a curved finger-retaining portion 22c. The operator performs a pulling or releasing action by placing his finger in contact with the finger retaining portion 22c.

The operation of the trigger valve 15 is effected in a manner described hereinunder.

Supposing here that the contact surface (not shown) of the trigger safety arm 24 is not pressed against the object, i.e. that the trigger engaging end 24a of the trigger lever 22 is not raised, the lever 23 cannot contact the manually operable stem 19a of the trigger valve piston 19, even if the trigger lever 22 is pulled, because the side plates 22b of the trigger lever 22 are simply pressed against the lower side 18a of the trigger valve cylinder 18. It is, therefore, impossible to lower the air pressure in the control chamber 11 of the head valve 8, so that the impact piston 4 remains stationary at the top dead center, as will be understood from FIG. 4.

The lever 22 cannot make contact with the manually operable stem 19a of the trigger valve piston 19, even if the contact surface of the trigger safety arm 24 is pressed against the object, unless the trigger lever 22 is pulled. In consequence, the air pressure in the control chamber 11 of the head valve 8 is never lowered.

When the trigger lever 22 is pulled with the contacting surface of the trigger safety arm 24 pressed against the object, the free end 23b of the lever 23 is moved to the upper position as it is supported by the trigger safety arm 24, and functions as a rotary end due to the engagement with the trigger engaging end 24a of the trigger safety arm 24, thereby to push up the manually operable stem 19a of the trigger valve piston 19. In consequence, the compressed air is removed from the control chamber 11 of the head valve 8 to the atmosphere through the control air passage, so that the head valve piston 10 is moved upward by the differential pressure between the total pressure acting on the shoulder portion 10b and the upper surface of the head valve piston 10. In consequence, the head valve 8 establishes the communication between the compressed air storage chamber 7 and the upper chamber 4a of the impact cylinder.

The safety valve 25, which includes the valve cylinder 13 and capable of being operated both automatically and manually, is located at the upper end of the housing cap 6, and is placed between the grip 26 and the main housing portion 2a which accomodates the impact piston cylinder-mechanism, and keeps such a posture as to extend transversely of the longitude of the grip 26.

Therefore, the operator can manually operate the safety valve 25 by his left hand while holding the grip 26 by his right hand, without altering the posture of the pneumatic nail driver 1.

Hereinafter, a description will be given as to the safety valve 25, with specific reference to FIGS. 2 to 5. Namely, the safety valve cylinder 13 is formed by boring a part of the housing cap 6. A bush 28 is inserted into one side (lower side in FIG. 2) of the safety valve cylinder 13. A safety valve piston 27 is slidably mounted in the safety valve cylinder 13 constituted by the bush 28 and a part of the housing cap 6.

Figure 2:
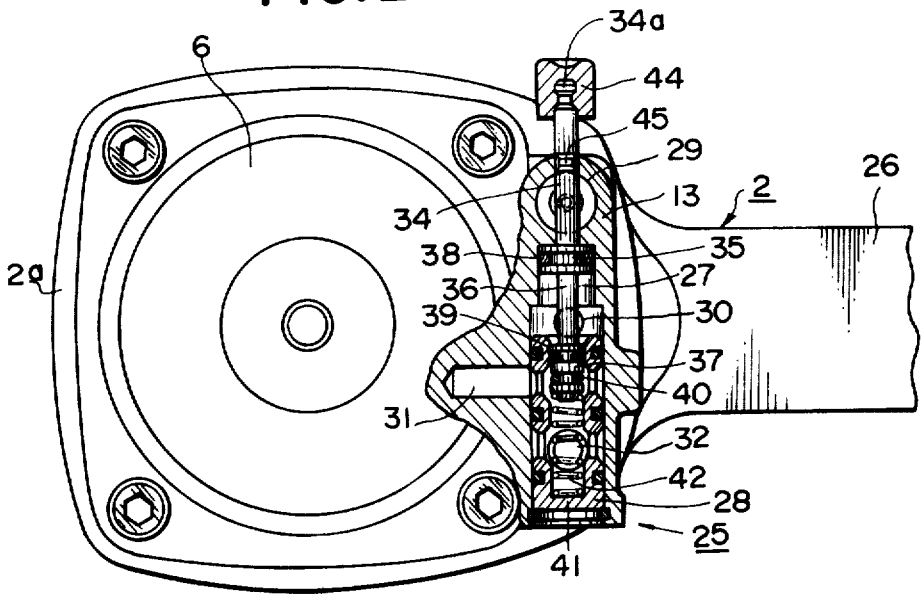
FIG. 2 is an enlarged sectional view taken along the line II—II of FIG. 1, in which a safety valve is shown in section and the safety system as a whole is shown in operative state.

The above-mentioned valve cylinder 13 is provided with a second connection port 30, a first connection port 31 and a mis-discharge prevention air introduction port 32, which are arrayed in the mentioned order from the upper to lower sides as viewed in FIG. 2.

Figure 3:
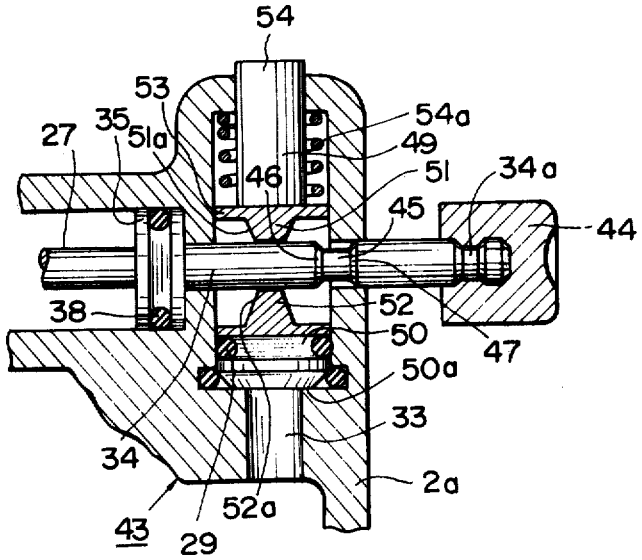
FIG. 3 is an enlarged sectional view of a locking mechanism of the safety system, taken along the line III—III of FIG. 1, in which the safety system is shown in operative state.

A lock cylinder 29 is formed by boring the housing 2, at a portion of the latter in the close proximity of the valve cylinder 13. This lock cylinder 29 is perpendicular to the safety valve cylinder 13, and is always communicated with the compressed air storage chamber 7 through the self-holding air introduction port 33 as shown in FIG. 3. The second connection port 30 always maintains a communication with the second control air passage 14, while the first connection port 31 is in communication with the first control air passage 12. Also, the mis-discharge prevention air introduction port 32 is always kept in communication with the compressed air storage chamber 7.

The above-mentioned safety piston 27 has a manually operable stem 34, large diameter piston 35, connecting stem 36 and small diameter piston 37 which are arrayed in the mentioned order from the upper to lower sides as viewed in FIG. 2. The manually operable stem 34 has an end 34*a* projected outwardly from the housing 2. An unlocking knob 44 is provided on the end 34*a*. The large diameter piston 35 and the small diameter piston 37 are slidable to the safety valve cylinder 13.

A first "0" ring 38 is fitted to the large diameter piston 35, while a second "O" ring 39 and third "O" ring 40 are fitted to the small diameter piston 37. A valve spring 42 of a compression spring type is interposed between the small diameter piston 37 and the end 41 of the bush 28. This valve spring 42 acts to maintain the safety valve piston 27 at the top dead center, even when the compressed air storage chamber 7 is not charged with the compressed air, i.e. even when the compressed air storage chamber 7 is disconnected from the compressed air source outside the pneumatic nail driver 1. (See FIG. 2)

Figure 4:
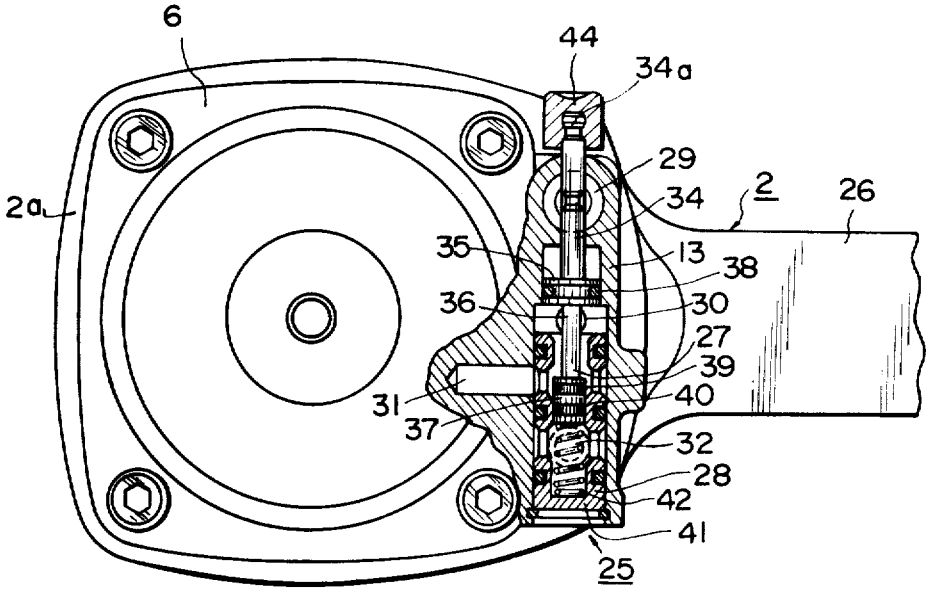
FIG. 4 is an enlarged sectional view of the safety valve in the inoperative state of the safety system.

As shown in FIG. 4, when the safety valve piston 27 in the bottom dead center, the communication between the second connection port 30 and the first connection port 31 is established, so that the first control air passage 12 is communicated with the second control air passage 14. In this state, the first control air passage 12 and the second control air passage 14 are blocked in communication with the mis-discharged prevention air introduced port 32 by the third "O" ring 40.

Therefore, the air pressure in the first control air passage 12 is under a perfect on-off control by the trigger valve 15.

A lock mechanism 43 mechanically engaging the manually operable stem 34 is incorporated as a part of the safety valve 25 for the self-holding of the latter. The detail of this lock mechanism 43 will be described hereinunder with specific reference to FIGS. 3 to 5. Namely, the manually operable stem 34 is provided with a reduced diameter portion 45 for locking purpose, formed near the end 34*a* of the same. Tapered shoulders 46 and 47 are formed at both ends of this reduced diameter portion 45. The manually operable stem 34 is freely engaged by a retaining opening 48 formed in a portion of the lock piston 49 accomodated by the lock cylinder 29. This retaining opening 48 has a diameter slightly greater than that of the manually operable stem 34 so as to provide such a play as to permit the lock piston 49 to move slightly in the transverse direction of the manually operable stem 34. A piston 50 is formed at the lower end of the lock piston 49. This piston 50 is adapted to slide in the lock cylinder 29 by the force of the compressed air which is supplied through the self-hold air introduction port 33.

At the opening upper edge 51 and opening lower edge 52 of the retaining opening 48, formed are tapered surface 51*a* or 52*a* extending upwardly or downwardly, respectively, from the shoulder 46 or 47 of the reduced diameter portion 45 for the locking. These tapered surfaces 51*a* and 52*a* are adapted to assist the lock piston 49 in moving into and out of engagement with the reduced diameter portion 45 smoothly.

Figure 5:
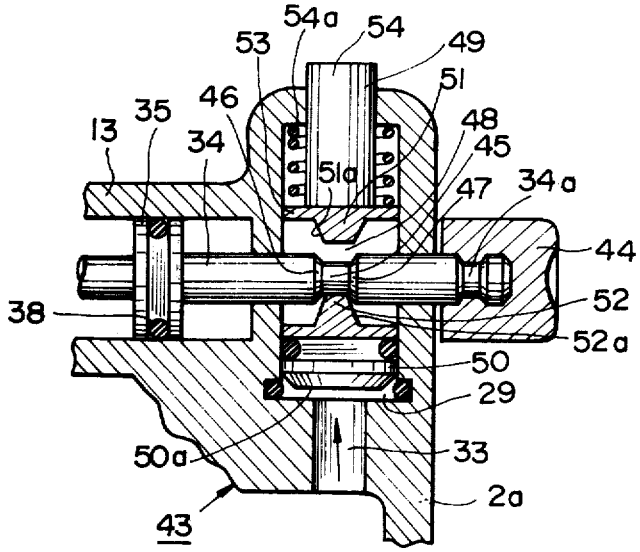
FIG. 5 is an enlarged sectional view of the locking mechanism, in the inoperative state of the safety system.

The lock piston 49 is provided with a spring retainer 53 connected to the tapered surface 51*a*. Further, a manually unlocking stem 54 is connected to the spring retainer 53. This manually unlocking stem 54 projects from the lock cylinder 29 to a position above the housing 2. Between the spring retaining plate 53 and the upper wall of the lock cylinder 29, disposed is a coiled compression spring 54*a* which normally acts to depress the lock piston 49. The spring force of this coiled compression spring 54*a* selected to be smaller than the upward force of the compressed air acting on the lower side 50*a* of the piston 50, so that it does perform no proper function when the compressed air is being introduced into the lower side 50*a* through the self-holding air introduction port 33 from the compressed air storage chamber 7, as illustrated in FIG. 5. The coiled compression spring 54*a* acts, when the compressed air storage chamber 7 is disconnected from the compression air source, i.e. when there is no air pressure in the compressed air storage chamber 7, to unlock the safety valve piston 27 and to urge the latter to the top dead center, as shown in FIG. 3. Namely, the safety system is turned into operative state in which the first control air passage 12 and second control air passage 14 are blocked one another in the mutual communication.

Hereinafter, the operation of the safety system will be described. When the compressed air storage chamber 7 is disconnected from the compressed air source, i.e. when no compressed air resides in the compressed air storage chamber 7, the compressed air in the control chamber 11 of the head valve 8 is released to the atmosphere via the control air passage constituted by the first control air passage 12 and second control air passage 14, and via the compressed air storage chamber 7. Thus, the pressure of the air in the control chamber 11 equals to the atmospheric pressure.

In this state, no compressed air is supplied to the self-holding air introduction port 33, so that no compressed air acts on the lower side 50*a* of the piston 50. Therefore, the lock piston 49 is kept stationary at the bottom dead center by the force of the coiled compression spring 54*a*. In this state, the safety valve piston 27 is stationarily held at the operative position of the safety system corresponding to the top dead center of the safety valve piston 27, by the spring force of the valve spring 42 as shown in FIG. 2. The opening lower edge 52 of the lock piston 49 does not engage the locking reduced diameter portion 45 of the manually operable stem 34 and is slightly spaced apart from the other outer surface of the manually operable stem 34, as shown in FIG. 3.

When the compressed air storage chamber 7 is kept separated from the compressed air source and, hence, the safety valve 25 is in operative state as shown in FIG. 2, the second "O" ring 39 interrupts the communication between the first control air passage 12 and second control air passage 14, while the mis-discharge prevention air introduction port 32 is communicated with the first control air passage 12.

Subsequently, when the compressed air storage chamber 7 is connected to the compressed air source through a hose for preparing the nail driving work, the compressed air is supplied from the compressed air storage chamber 7 simultaneously to the lock cylinder 29 and the mis-discharge prevention air introduction port 32. There is no time lag or difference between the action of the compressed air supplied to the control chamber 11 through the mis-discharge prevention air introduction port 32 and the action of the compressed air directly supplied from the compressed air storage chamber 7 to the shoulder 10*b* of the head valve piston 10.

The supply of the compressed air to the second connection port 30 is made with a certain time lag to the supply of the same to the lock cylinder 29 and the mis-discharge prevention air introduction port 32, partly because the second control air passage 14 always communicating with the second connection port 30 includes the trigger valve 15 which produces a throttling effect and partly because the length of the second control air passage 14 is larger than the distance between the compressed air storage chamber 7 and the mis-discharge prevention air introduction port 32 or the lock cylinder 29.

Thus, at the moment immediately after the connection of the compressed air storage chamber 7 to the compressed air source, the pressure of the compressed air is applied to the shoulder 10*b* and the upper face 10*c* of the head valve piston 10, without substantial time difference, and the supply of compressed air to the mis-discharge prevention air introduction port 32 from the compressed air storage chamber 7 is made earlier than the supply of the compressed air to the second connection port 30. Therefore, the safety valve piston 27 is never moved to the inoperative position of the safety system even at the instant immediately after the connection of the compressed air storage chamber 7 to the compressed air source. At the same time, the head valve piston 10 is prevented from moving from the bottom dead center to the top head center, so as not to effect the initial mis-discharge of the impact piston 4.

The compressed air which has been supplied to the lock cylinder 29 from a moment immediately after connecting the compressed air storage chamber 7 to the compressed air source cannot cause the upward movement of the piston 50, because the opening upper edge 52 of the lock piston 49 does not make contact with the locking reduced-diameter portion 45 but with other portion of the manually operable stem 34.

On the other hand, a part of the pressure of the compressed air which is supplied to the second connection port 30 after elapse of predetermined time corresponding to the time lag of working of compressed air is negated by the force of the compressed air which is introduced through the mis-discharge prevention air introduction port 32 to act on the small diameter piston 37.

The force of the compressed air introduced into the safety valve cylinder 13 via the second connection port 30, acting on the large diameter piston 35, acts in the same direction as the spring force of the valve spring 42 and continuously holds the safety valve piston 27 at the top dead center thereof.

In the operative state of the safety system as shown in FIGS. 2 and 3, the compressed air coming into the safety valve cylinder 13 via the mis-discharge prevention air introduction port 32 is supplied to the control chamber 11 of the head valve 8, without lagging behind the action of the compressed air supplied through the first connection port 31 and the first control air passage 12 to the shoulder 10*b* of the head valve piston 10, so as to apply a force to the upper face 10*c* of the head valve piston 10. It is, therefore, possible to hold the head valve piston 10 at the bottom dead center until the manually operable stem 34 is operated, provided that there is no solidification of lubricating oil in the compressed air to permit safe operation of the valve spring 10*a*. If there is any solidification of the lubricating oil to hinder the safe operation of the valve spring 10*a* so that the head valve piston 10 may not be held at the bottom dead center when the compressed air storage chamber 7 is brought into connection with the compressed air source. Even in such a case, according to the invention, the head valve piston 10 is moved to the bottom dead center without delay, so that the initial discharge of the impact piston 4 is fairly avoided.

Further, in the operative state of the safety system, the control air passage of which internal air pressure being under the control of the trigger valve 15 is blocked at its intermediate portion. Therefore, the pressure drop of air in the control chamber 11 is avoided even when a part of the compressed air in the control air passage is released to the atmosphere due to any trouble of the trigger valve 15. In consequence, the initial discharge of the impact piston 4, which may take place as a result of the movement of the head valve piston 10 from the bottom dead center to the top dead center due to the pressure drop of air in the control chamber 11 is prevented.

The movement of the safety valve piston 27 to the top dead center, which takes place automatically when the compressed air storage chamber 7 is disconnected from the compressed air source, is an important and effective one of functions of the safety system, particularly when the operator of the pneumatic nail driver 1 is urged to take an unstable posture.

When the nail driving work is commenced after the completion of preparation, the nose of the pneumatic nail driver 1 is directed toward the object, rather than a part of the operator's body, and the operator takes a stable posture for the nail driving work. As the operator in this state manually moves the safety valve piston 27 to the bottom dead center corresponding to the inoperative position of the safety system as shown in FIG. 4 by the manipulation of the unlocking knob 44, the opening lower edge 52 of the lock piston 49 is brought into engagement with the locking reduced diameter portion 45 as shown in FIG. 5 to lock the safety valve piston 27 at this position. In consequence, the communication between the first control air passage 12 and the mis-discharge prevention air introduction port 32 is blocked, while the communication between the first control air passage 12 and the second control air passage 14 is established, so that air pressure in the control chamber 11 is under a perfect on-off control by the trigger valve 15.

When it is desired to turn the safety system operative in a nail driving work while keeping the compressed air storage chamber 7 in the state connected to the compressed air source, the operator depresses the manual unlocking stem 54 overcoming the force of the compressed air acting on the piston 50. By so doing, the opening lower edge 52 of the lock piston 49 is disengaged from the locking reduced diameter portion 45 of the manually operable stem 34. In consequence, the safety valve piston 27 is moved to the top dead center as shown in FIG. 2, by the combined force of the valve spring 42 and the compressed air supplied into the safety valve cylinder 13 through the mis-discharge prevention air introduction port 32, and the first control air passage 12 is disconnected from the second control air passage 14. Simultaneously, a communication is established between the mis-discharge prevention air introduction port 32 and the first control air passage 12, so that a safe condition is achieved in which the air pressure in the control chamber 11 can no more be controlled by the trigger valve 15.

When the air hose leading from the compressed air source is disconnected from the compressed air introduction port (not shown) of the compressed air storage chamber 7 after the nail driving operation, the coiled compression spring 54*a* and the valve spring 42 come to perform their proper functions to move the safety valve piston 27 to the top dead center as shown in FIG. 2, thereby to turn the safety system into operative state, as has been described already.

As a modification, the self-holding air introduction port 33 may be provided at the same side of the lock piston 49 as the top dead center. In this case, the coiled compression spring 54*a* is disposed at the same side as the bottom dead center of the lock piston 49, while the piston 50 is formed to confront the self-holding air introduction port 33.

Hereinafter, a safety system of another embodiment of the invention will be described in detail with reference to FIGS. 6 and 7. These Figures show mainly the safety valve 55 of the safety system. The safety valve 55 has a safety valve cylinder 56 formed by boring the housing 2. A safety valve piston 57 is accommodated by the safety valve cylinder 56. The safety valve cylinder 56 is provided with three air ports 58, 59 and 60 arrayed in the mentioned order from the left side to the right side as viewed in FIG. 6. The second connection port 58 disposed at the left end portion is always communicated with the second control air passage 14. The first connection port 59 disposed at an intermediate position is always communicated with the first control air passage 12. The right end port, i.e. the mis-discharge prevention air introduction port 60 is always communicated with the compressed air storage chamber 7 through an air passage which is not shown.

At an intermediate portion of the safety valve cylinder 56, formed is an intermediate valve seat 61. A top chamber 62 is formed at one (left) side 61*a* of the intermediate valve seat 61, i.e. at the same side as the top deat center of the safety valve piston 57, while a bottom chamber 63 is formed at the other (right) side 61*b* of the intermediate valve seat 61, i.e. at the same side as the bottom dead center of the safety valve piston 57. A small diameter piston 64 of the safety valve piston 57 slides in the top chamber 62, while a large diameter piston 65 of the safety valve piston 57 slides in the bottom chamber 63. A first "O" ring 66 is fitted to the small diameter piston 64, while a second "O" ring 67 is fitted to the large diameter piston 65. The large diameter piston 65 and the small diameter piston 64 are connected to one another by means of interconnecting stem 68 to which fitted at the other side 61*b* of the large piston 65 is a third "O" ring 69.

A manually operable stem 68*a* is formed to project from the large diameter piston 65 toward the bottom dead center of the safety valve piston 57. A knob 70 is attached to one end of the manually operable stem 68*a*. This knob 70 is positioned always outside the housing 2 of the pneumatic nail driver 1. A small gap is formed in the sliding area between the housing 2 and the manually operable stem 68*a*, for releasing the residual air from the bottom chamber 63 to the atmosphere.

The large diameter piston 65 is always biased toward the top dead center by a valve spring 65*a* of a coiled compression spring type. When there is no compressed air in the compressed air storage chamber 7, the third "O" ring 69 is depressed against the intermediate valve seat 61.

An back-pressure removing air passage 71 is formed to communicate with the bottom chamber 63. This back-pressure removing air passage 71 is provided for enhancing the sealing effect of the third "O" ring 69.

Figure 6:
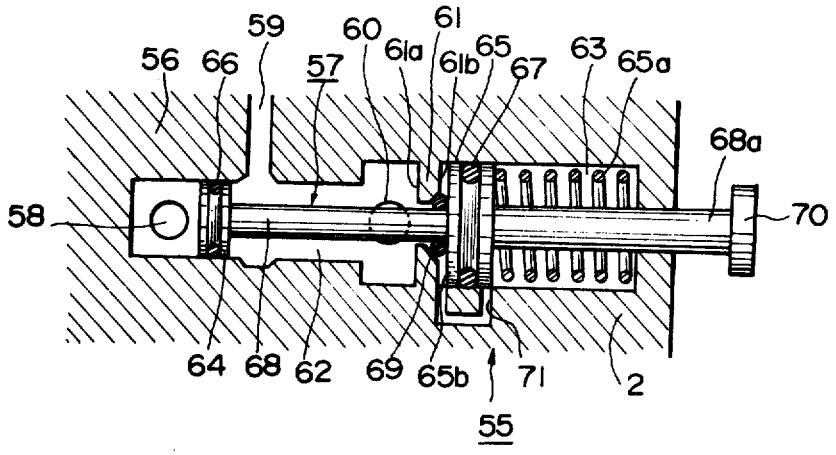
FIG. 6 is a longitudinal sectional view of the safety valve incorporated in the safety system of another embodiment, in the operative state of the safety system.
Figure 7:
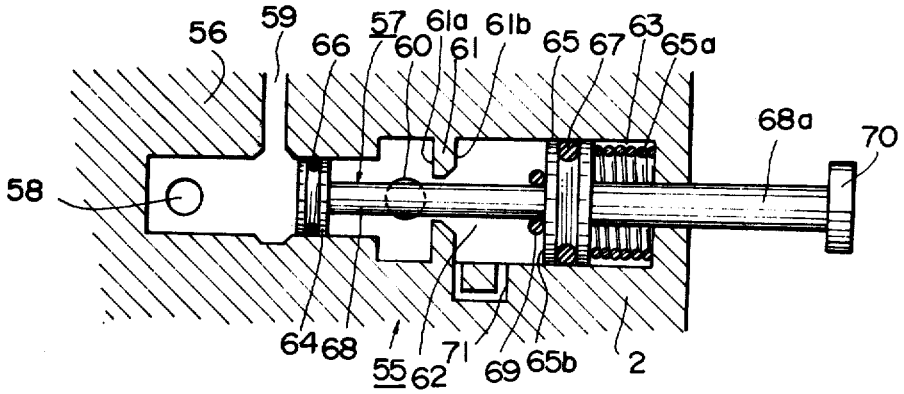
FIG. 7 is a longitudinal sectional view of the safety valve shown in FIG. 6, but in the inoperative state of the safety system.

The safety system including the safety valve 55 shown in FIGS. 6 and 7 operates in a manner described hereinunder. When the compressed air storage chamber 7 of the pneumatic nail driver 1 is kept separated from the compressed air source. i.e. when there is no compressed air in the compressed air storage chamber 7, the safety valve piston 57 is kept stationary at the top dead center (left end position in safety valve cylinder 56) as shown in FIG. 6, by the force of the valve spring 65*a*. When the safety valve piston 57 is located at this position, the first "O" ring 66 interrupts the communication between the first connection port 59 and second connection port 58, while the mis-discharge prevention air introduction port 60 is in communication with the first connection port 59.

When the compressed air is charged into the compressed air storage chamber 7 in this state, the compressed air is supplied through the mis-discharge prevention air introduction port 60 into the top chamber 62 to charge up the latter. Simultaneously, the compressed air is supplied to the control chamber 11 of the head valve 8, because the mis-discharge prevention air introduction port 60 is in this state communicated with the first connection port 59. The compressed air in the top chamber 62 acts on the third "O" ring 69 to generate a force to urge the safety valve piston 57 rightwardly, i.e. toward the bottom dead center. This compressed air also generates a force which acts on the small diameter piston 64 to urge the safety valve piston 57 to the left, i.e. toward the top dead center. However, due to the difference of diameter between the third "O" ring 69 and the small diameter piston 64, the safety valve piston 57 is urged toward the top dead center. In consequence, the safety valve piston 57 stands still at the top dead center, so that the first "O" ring 66 keeps disconnecting the first connection port 59 and second connection port 58 one another. In consequence, the first control air passage 12 and second control air passage 14 are disconnected one another. Thus, the safety system takes the operative state in which the air pressure in the control chamber 11 is not subject to the control of the trigger valve 15.

When the knob 70 is slightly pulled to the right from the position shown in FIG. 6, a sealing by the third "O" ring 69 is removed so that the compressed air is charged also into the bottom chamber 63 through the mis-discharge prevention air introduction port 60, so as to urge the large diameter piston 65 downwardly.

The actual component of the pressure of the compressed air acting on the safety valve piston 57 to drive the latter toward the bottom dead center is the differential pressure obtained by a subtraction of the component which acts on the small diameter piston 57 to urge the latter toward the top dead center. The force urging the large diameter piston 65 toward the bottom dead center overcomes the force of the spring 65a, so that the safety valve piston 57 is moved to and held stationary at the bottom dead center as will be seen from FIG. 7.

In consequence, the communication between the first connection port 59 and the mis-discharge prevention air introduction port 60 is interrupted by the first "O" ring 66 and, at the same time, a communication is established between the first connection port 59 and second connection port 58 to bring the first control air passage 12 and second control air passage 14 one another into communication. In this state, the air pressure in the control chamber 11 is under a perfect on-off control by the trigger valve 15. Thus, in this state, the safety system is inoperative.

Then, when the compressed air storage chamber 7 is disconnected from the compressed air source, the compressed air in the top chamber 62 and bottom chamber 63 is released to the atmosphere through the mis-discharge prevention air introduction port 60 and the compressed air storage chamber 7. In consequence, the safety valve piston 57 is moved by the force of the valve spring 65a to the top dead center, i.e. to the left as viewed in the drawings, and is held stationary at that position. Thus, the safety system takes the operative state. This operative state of the safety system is maintained when the compressed air storage chamber 7 is connected again to the compressed air source.

If it is desired to make the safety system operative during the work, without disconnecting the compressed air storage chamber 7 from the compressed air source, the operator thrusts the knob 70 upward overcoming the differential force of the compressed air acting on the large diameter piston 65 to depress the safety valve piston 57 downward. Then, when the third "O" ring 69 is seated on the intermediate valve seat 61, the supply of the compressed air acting on the large diameter piston 65 is stopped. At the same time, the compressed air charged in the chamber of the top chamber 62, defined by the large diameter piston 65, third "O" ring 69 and the intermediate valve seat 61 is released to the atmosphere through the air passage 71 for removing the back pressure. In consequesnce, the safety valve piston 57 is held at the top dead center by the force of the valve spring 65a.

A safety system of still another embodiment will be described hereinunder with reference to FIGS. 8 and 9 which show only the safety valve 72 of the safety system of this embodiment. The safety valve 72 has a safety valve cylinder 73 formed by boring the housing 2 and accommodating a safety valve piston 74 which is biased toward the top dead center, i.e. to the right as viewed in FIG. 8, by a coiled compression spring type valve spring 100. The safety valve cylinder 73 is provided with six air ports 77, 76, 75, 79a, 78 and 79 arrayed in the mentioned order as viewed from left to right in FIG. 8. The second connection port 75 is maintained always in communication with the second control air passage 14, while the first connection port 76 is always communicated with the first control air passage 12. The mis-discharge prevention air introduction port 77 is always kept in communication with the compressed air storage chamber 7. Also, the self-holding air introduction port 78 is held in communication with the compressed air storage chamber 7. The first exhaust port 79 is connected to a exhaust valve 80 while a second exhaust port 79a is always in communication with the atmosphere.

A first small diameter piston 81 is formed at the left end of the safety valve piston 74, while a second small diameter piston 82 is provided at the intermediate portion of the safety valve piston 74. Further, a large diameter piston 83 is formed at the right side of the second small diameter piston 82. The first small diameter piston 81 and second small diameter piston 82 have an equal diameter. A first "O" ring 84 is fitted around the first small diameter piston 81. A second "O" ring 85 around the second small diameter piston 82. A third "O" ring 86a and fourth "O" ring 86b are fitted around the large diameter piston 83. The piston 81, 82 and 83 are connected with each other by a connecting stem 87. A manually operable stem 88 is formed to project from the large diameter piston 83 to extend out of the safety valve cylinder 73. This manually operable stem 88 is constituted by a small diameter stem 88a adjacent to the large diameter piston 83 and a large diameter stem 88b connecting to the small diameter stem 88a. A knob 95 is formed on the end portion of the large diameter stem 88b. *An opening 89 for receiving the manually operable stem 88 is formed in the right end of the safety valve cylinder 73. A fifth "O" ring 90 is fitted to the inner wall surface of the opening 89. The fifth "O" ring 90 is adapted to engage the large diameter stem 88b* to seal the top chamber 98a from the atmosphere.

The exhaust valve 80 is a kind of check valve. An exhaust valve cylinder 91 accommodates an exhaust valve piston 92 at the left end thereof having a piston portion 93 to which connected is a valve stem 94. The right end portion of the valve stem 94 project to the outside of the housing 2 of the pneumatic nail driver 1. An air purge knob 95a is attached to the right end of the valve stem 94. The valve stem 94 is adapted to move into and out of an opening 94a which is formed in the housing 2 to communicate with the interior of the exhaust valve cylinder 91. The amount of air discharged to the atmosphere through this opening 94a is set to be greater than the amount of air flowing from the self-holding air introduction port 78 into the safety valve cylinder 73, by a specific construction of the exhaust valve 80.

Figure 8:
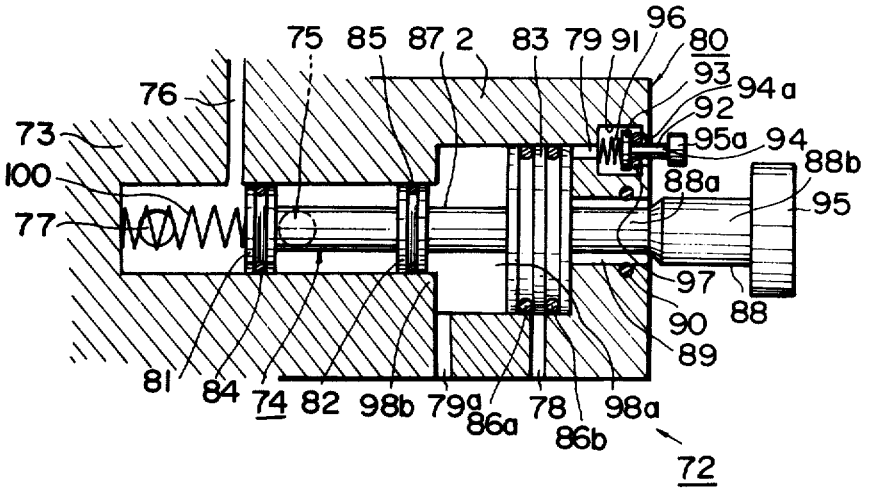
FIG. 8 is a longitudinal sectional view of the safety valve incorporated in a safety system of still another embodiment, in the operative state of the safety system.
Figure 9:
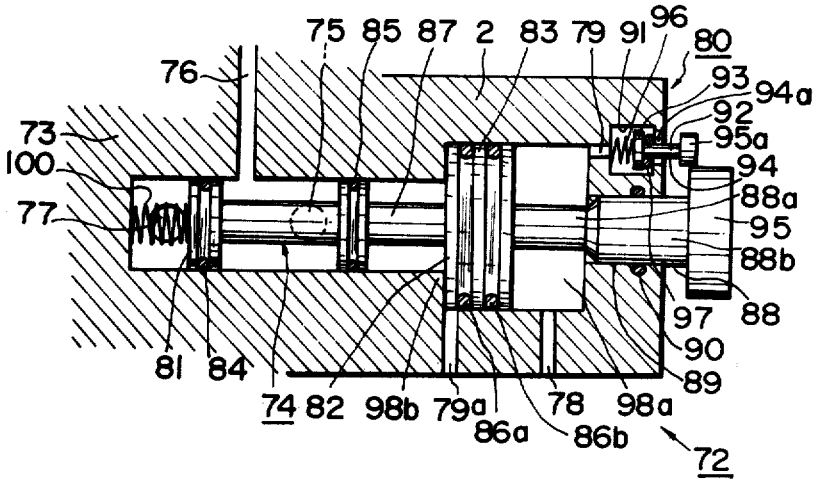
FIG. 9 is a longitudinal sectional view of the same safety valve as shown in FIG. 8, but in the inoperative state of the safety system.

A coiled compression type valve spring 96 exerts a resetting force on the left end surface of the exhaust piston 93, thereby to bias the exhaust valve piston 92 to the right as viewed in FIGS. 8 and 9. A sixth "O" ring 97 is fitted around the portion interconnecting the valve stem 94 and the exhaust piston 93.

In the normal state in which the top chamber 98a formed at the right side, i.e. the same side as the top dead center of the safety valve piston 74, of the large diameter piston 83 is communicated with the atmosphere through the gap between the opening 89 and the manually operable stem 88, the exhaust valve piston 92 is held stationary at the right end position, i.e. at the top dead center of the exhaust valve piston 92, by the resetting force of the valve spring 96.

In this state, the air pressure in the bottom chamber 98b, which is formed at the left side (the same side as the bottom dead center of the safety valve piston 74) of the large diameter piston 83 by the cooperation of the large diameter piston 83 and small diameter piston 82, is also lowered to the level of atmospheric pressure due to the action of the second exhaust port 79a.

The exhaust valve cylinder 91 is kept isolated from the atmosphere, by the sixth "O" ring 97.

The safety system of this embodiment incorporating the described safety valve 72 operates in a manner described hereinunder. When there is no compressed air in the compressed air storage chamber 7 as a result of disconnection of the latter from the compressed air source, the safety valve piston 74 is held at the top dead center as shown in FIG. 8 by the action of the valve spring 100.

In this state, the first "O" ring 84 is interrupting the communication between the second connection port 75 and first connection port 76, while the mis-discharge prevention air introduction air port 77 is in communication with the first connection port 76. Therefore, the control chamber 11 of the head valve 8 is in communication with the compressed air storage chamber 7 via the first control air passage 12, first connection port 76 and the mis-discharge prevention air introduction port 77.

On the other hand, the communication between the mis-discharge preventing air introduction port 77 and second connection port 75 is interrupted by the first "O" ring 84, while the second connection port 75 is always disconnected from the bottom chamber 98*b* by the second "O" ring 85 and third "O" ring 86*a*.

The self-holding air introduction port 78 is disconnected from both of the top chamber 98*a* and bottom chamber 98*b* by the third "O" ring 86*a* and fourth "O" ring 86*b*.

The top chamber 98*a* is communicated with the atmosphere through the opening 89. Also, the bottom chamber 98*b* is communicated with the atmosphere through the second exhaust port 79*a*.

Then, when the compressed air storage chamber 7 is connected to the compressed air source through the air hose, the compressed air is supplied from the compressed air storage chamber 7 simultaneously to the mis-discharge prevention air introduction port 77 and the self-holding air introduction port 78. The supply of the compressed air to the second connection port 75 is somewhat lagged behind the supply of the same to these ports 77 and 78. The compressed air supplied to the safety valve cylinder 73 through the second connection port 75 and the self-holding air introduction port 78 does not produce any force which would cause a movement of the safety valve piston 74.

On the other hand, the compressed air supplied from the mis-discharge prevention air introduction port 77 into the safety valve cylinder 73 is further delivered to the control chamber 11 of the head valve 8, because the mis-discharge prevention air introduction port 77 is instantaneously brought into communication with the first connection port 76, and acts on the first small diameter piston 81 to produce a force which urges the safety valve piston 74 toward the top dead center. In consequence, the safety valve piston 74 is continuously held at the top dead center as shown in FIG. 8. The compressed air charged into the control chamber 11 does never undergo the control of the trigger valve 15. Therefore, an accidental discharge of the impact piston 4 due to any change of state of the trigger valve is completely eliminated.

When the nail driving work is started after the completion of the preparation, the knob 95 is depressed to move the safety valve piston 74 toward the bottom dead center, thereby to insert the large diameter stem 88*b* into the opening 89. In consequence, the fifth "O" ring 90 is brought into engagement with the large diameter stem 88*b*, so that the top chamber 98*a* is sealed against the atmospheric air by the fourth "O" ring 86*b* and fifth "O" ring 90.

The compressed air supplied into the top chamber 98*a* through the self-holding air introduction port 78 acts to urge the large diameter piston 83 toward the bottom dead center of the safety valve piston 74. This thrust force overcomes the total force of the spring 100 and the compressed air acting on the first small diameter piston 81, so that the safety piston 74 is moved toward the bottom dead center and held stationary at that position. (See FIG. 9)

In the state in which the safety valve piston 74 is held at the bottom dead center as shown in FIG. 9, the communication between the first connection port 76 and the mis-discharge prevention air introduction port 77 is interrupted by the first "O" ring 84, while a communication is established between the first connection port 76 and second connection port 75, so that the first control air passage 12 and second control air passage 14 are communicated one another. In this state, the air pressure in the control chamber 11 is under a perfect on-off control of the trigger valve 15.

When the compressed air storage chamber 7 is disconnected from the compressed air source after the completion of the nail driving work, the compressed air in the safety valve cylinder 73 is instantaneously discharged to the atmosphere through the mis-discharge prevention air introduction port 77 and the self-holding air introduction port 78, and via the compressed air storage chamber 7. Also, a release is made through the second connection port 75 and via the compressed air storage chamber 7, at a certain time lag. In consequence, the safety valve piston 74 is reset to the top dead center by the resetting force of the valve spring 100. Thus, the safety system is turned into operative state.

For manually making the safety system operative during the nail driving work without disconnecting the compressed air storage chamber 7 from the compressed air source, the operator pushes the air removal knob 95*a* of the exhaust valve 80 to the left as viewed in FIG. 9, so that the sixth "O" ring breaks the seal to open the top chamber 98*a* to the atmosphere. Since the amount of compressed air per unit time flowing into the top chamber 98*a* through the self-holding air introduction port 78 is greater than the amount of air per unit time exhausted to the atmosphere through the exhaust valve 80, the air pressure in the top dead center 98*a* is lowered. In consequence, the force acting on the safety valve piston 83 toward the bottom dead center is reduced so that the safety valve piston starts to move toward the top dead center by the resetting force of the valve spring 100. During this upward movement of the safety valve piston 83, the large diameter stem 88*b* is disengaged from the fifth "O" ring 90, so that the air pressure in the top chamber 98*a* is further reduced to permit the safety valve piston 83 to reach the top dead center. In this state, the self-holding air introduction port 78 is closed by the third "O" ring 86*a* and fourth "O" ring 86*b*. In consequence, the safety valve piston 83 is held by itself at such a position as to permit the safety system to operate, by the combined force of the resetting force of the valve spring 100 and the compressed air supplied through the mis-discharge air introduction port 77.

The control chamber 11 is kept separated from the second control air passage 14. At the same time, a communication is established between the control chamber 11 and the compressed air storage chamber 7, via the mis-discharge air introduction port 77, so that the safety system becomes operative.

Figure 10:
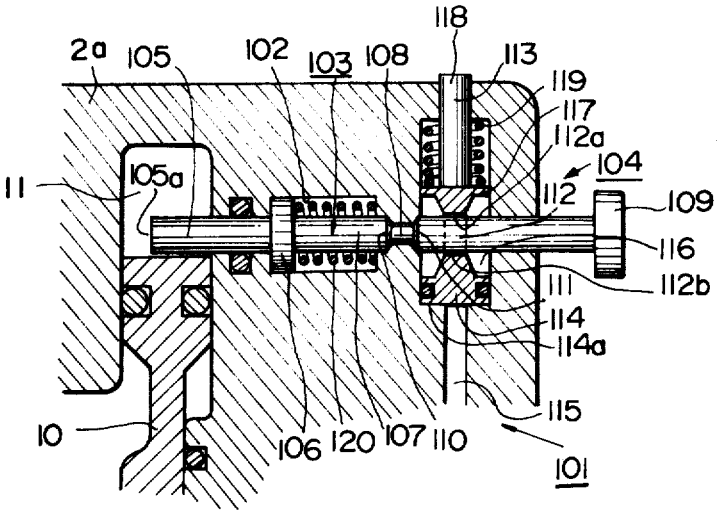
FIG. 10 is a longitudinal sectional view of a safety cylinder device incorporated in a safety system of a further embodiment of the invention, in the operative state of the safety system.

A safety system of a further embodiment of the invention will be described hereinunder with reference to FIGS. 10 and 11. This safety system includes a safety cylinder device 101 which is provided with a locking mechanism 104 which acts as means for self-holding the safety cylinder device 101. The safety cylinder device 101 includes a safety cylinder 102, safety plunger 103 and a coiled compression spring 120. This safety system is adapted, in contrast to those of the preceding embodiments, to forcibly prevents the movement of the head valve piston 10 toward the top dead center of the head valve piston 10, by making a part of the safety plunger 103 contact the head valve piston 10. Namely, the second control air passage 14 is directly connected to the first control air passage 12, detouring the safety cylinder device 101.

A lock stem 105 adapted to move into and out of the control chamber 11 is provided at the left end portion of the safety operation plunger 103. A disc 106 is provided at the right end of the lock stem 105. The lock stem 105 is adapted to make contact with the upper face 10c of the head valve piston 10 resting at the bottom dead center. A manually operable stem 107 is extended further from the disc 106 in the rightward direction. A part of this manually operable stem 107 is always exposed to the outside of the housing 2. A pulling knob 109 is provided at the right end of the manually operable stem 107. A reduced diameter portion 108 for locking purpose is formed at an intermediate portion of the manually operable stem 107.

The safety plunger 103 is always biased toward the top dead center (to the left as viewed in FIG. 10) thereof, by the resetting force of the coiled compression spring 120. Tapered shoulders 110 and 111 are formed at both ends of the reduced diameter portion 108 for locking. The manually operable stem 107 is loosely engaging a retaining opening 112 formed in a portion of the lock piston 113 of the locking mechanism 104. This retaining opening 112 perform the same function as the retaining opening 48. A piston portion 114 is formed at the lower end of the lock piston 113. This piston portion 114 is adapted to make sliding movement in the lock cylinder 116, upon receipt of the air pressure signal which comes through the self-holding air introduction port 115 maintaining a constant communication with the compressed air storage chamber 7.

Tapered surfaces corresponding to the shoulders 110 and 111 of the reduced diameter portion 108 are formed to extend upward and downward from the opening upper edge 112a and opening lower edge 112b of the retaining opening 112. The lock piston 113 is further provided with a spring retainer 117 and a manually unlocking stem 118. An upper end of the manually unlocking stem 118 is exposed to the outside of the housing 2. The spring retainer 117 is always loaded with the spring force of the coiled compression spring 119. The resetting force of the coiled compression spring 119 is smaller, even in the fully compressed state of the spring 119, than the upward force which is exerted by the compressed air on the lower surface 114a of the piston 114. When the compressed air storage chamber 7 is not charged with the compressed air, the coiled compression spring 119 acts to hold the lock piston 113 at the bottom dead center. As the piston 114 is seated on the lower wall surface of the lock cylinder 116, the manually operable stem 107 does make contact with neither of the opening upper edge 112a nor opening lower edge 112b of the retaining opening 112. This safety system operates in a manner described hereinunder. When the compressed air storage chamber 7 is kept separated from the compressed air source, the lock piston 113 is held at the bottom dead center by the resetting force of the coiled compression spring 119, because there is no compressed air in the self-holding air introduction port 115. In this state, the safety operation plunger 103 rests at the top dead center thereof as shown in FIG. 10, due to the resetting force of the coiled compression spring 120. In this state, the lock stem 105 is fully projected into the control chamber 11 to contact the upper face 10c of the head valve piston 10 to prevent the latter from moving upward. Meanwhile, the opening upper edge 112a and opening lower edge 112b of the lock piston 113 do not engage with the reduced diameter portion 108, and confront other portions of the manually operable stem 107. (See FIG. 10)

Then, when the compressed air storage chamber 7 is brought into connection with the compressed air source, the compressed air is instantaneously supplied into the lock cylinder 116 through the self-holding air introduction port 115. This compressed air acts to produce a force which is exerted on the lower surface 114a of the piston 114 to lift the lock piston 113. However, since the opening lower edge 112b of the lock piston 113 is brought into contact with the other portion of the manually operable stem 107 rather than the reduced diameter portion 108, no further movement of the lock piston 113 takes place. In addition, since the resetting force of the coiled compression spring 120 is greater than the total pressure of compressed air acting on the left end surface 105a of the lock stem 105, the head valve piston 10 is prevented from moving from the bottom dead center to the top dead center, even when the air pressure in the control chamber 11 is changed by a manual operation of the trigger valve 15, because the lock stem 105 checks such an upward movement of the head valve piston 10. Namely, the safety system is in operative state.

Figure 11:
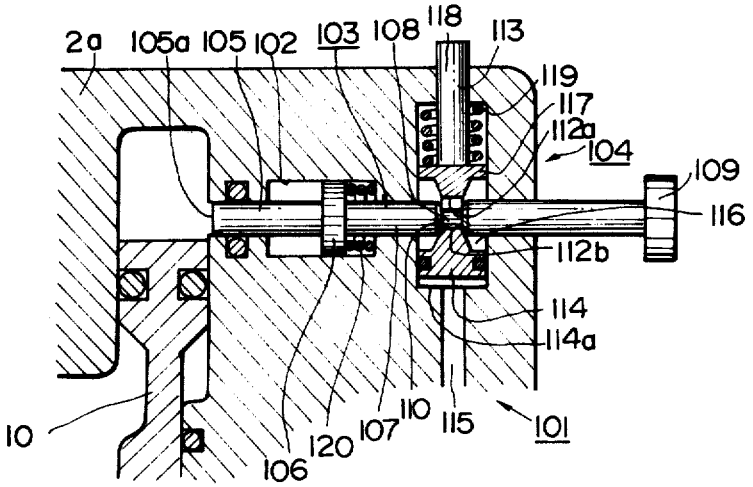
FIG. 11 is a longitudinal sectional view of the same safety cylinder device as shown in FIG. 10, in the inoperative state of the safety system.

For starting the nail driving operation after completion of the preparation, the pulling knob 109 is manually pulled to bring the safety piston 103 to the bottom dead center, as shown in FIG. 11. In consequence, the opening lower edge 112b of the lock piston 113 is brought into engagement with the reduced diameter portion 108 due to the action of the compressed air which is supplied through the self-holding air introduction port 115, so that the opening lower edge 112b is continuously urged upward thereby to lock the safety piston 103 at this position.

The head valve piston 10 is unlocked because the lock stem 105 is fully retracted from the control chamber 11 as shown in FIG. 11. Namely, the safety system is in inoperative state as shown in FIG. 11.

Then, as the compressed air storage chamber 7 is disconnected from the compressed air source after completion of the nail driving work, the compressed air is discharged to the atmosphere from the compressed air storage chamber 7. Subsequently, the compressed air in the lock cylinder 116 is released to atmosphere without substantial delay through the self-holding air introduction port 115 and the compressed air storage chamber 7. In consequence, the lock piston 113 is moved toward the bottom dead center due to the resetting force of the coiled compression spring 119, so that the opening lower edge 112b is disengaged from the reduced diameter portion 108, so that the safety operation plunger 103 is reset to the top dead center by the resetting force of the coiled compression spring 120.

When it is desired to make the safety device operative as desired without disconnecting the compressed air storage chamber 7 from the compressed air source, the manually unlocking stem 118 is depressed overcoming the force of the compressed air acting on the lower side 114*a* of the piston 114. In consequence, the opening lower edge 112*b* of the lock piston 113 is disengaged from the reduced diameter portion 108 and, at the same time, the safety plunger 103 is moved to the operative position of the safety system by the resetting force of the coiled compression spring 120. In consequence, the lock stem 105 is projected into the control chamber 11 into contact with the upper face 10*c* of the head valve piston 10. As a result, the head valve piston 10 is strongly held at the bottom dead center, independently of the control of the trigger valve 15.

Figure 12:
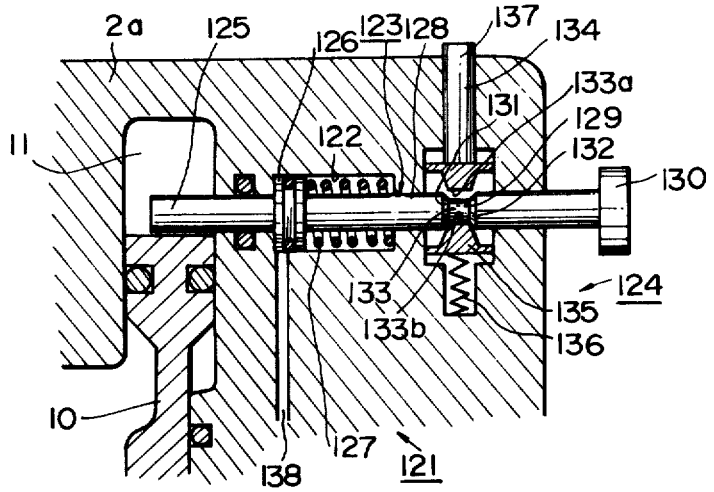
FIG. 12 is a longitudinal sectional view of a safety cylinder device incorporated in a safety system of a still further embodiment of the invention, in the operative state of the safety system.

Hereinafter, a safety system of a still further embodiment of the invention will be described with reference to FIGS. 12 and 13. As in the case of the embodiment shown in FIGS. 10 and 11, this embodiment has means for forcibly checking the movement of the head valve piston 10 toward the top dead center, upon a mechanical engagement with the latter.

This safety system includes a safety cylinder device 121 provided with a lock mechanism 124. The safety cylinder device 121 further includes a safety cylinder 122, safety piston 123 and the coiled compression spring 127.

The second control air passage 14 is directly connected to the first control air passage 12, without detouring the safety cylinder device 121.

A lock stem 125 adapted to come into and out of the control chamber 11 is provided at the left end portion of the safety piston 123. A piston 126 is provided at the right end of the lock stem 125. The lock stem 125 is adapted to make contact with the upper face 10*c* of the head valve piston 10 resting at the bottom dead center.

A reduced diameter portion 129 for locking is formed at an intermediate portion of the manually operable stem 128 projection rightwardly from the piston 126. A knob 130 is provided at the right end of the manually operable stem 128 projected out of the housing 2. Tapered shoulders 131 and 132 are formed at both ends of the reduced diameter portion 129. The manually operable stem 128 is in loose engagement with the retaining opening 133 of the lock piston 134. The lower one 133*b* of the opening upper edge 133*a* and opening lower edge 133*b* has an engagement with the reduced diameter portion 129. A lock plunger 134, which is a constituent of the lock mechanism 124, has a plunger portion 135 and an unlocking stem 137. The lock plunger 134 is always biased toward the top dead center (upwardly as viewed in FIGS. 12 and 13) by a coiled compression spring 136 which acts to urge the plunger 135 upward.

At the left end of the safety cylinder 122 opened is a self-holding air introduction port 138 which is held in continuous communication with the compressed air storage chamber 7.

The operation of the safety system of this embodiment will be described hereinunder with reference to FIGS. 12 and 13. When the compressed air storage chamber 7 is kept separated from the compressed air source, the safety piston 123 is held stationary at the top dead center by the resetting force of the coiled compression spring 127. In this state, the lock stem 125 projects into the control chamber 11 and contacts the upper face 10*c* of the head valve piston 10 to prevent the latter from moving toward the top dead center. In this state, the lock plunger 134 rests at the top dead center, because the opening lower edge 133*b* of the lock plunger 134 is engaged with the reduced diameter portion 129.

Then, as the compressed air storage chamber 7 is connected to the compressed air source during the preparation for the nail driving work, compressed air is supplied to the safety cylinder 122 from the compressed air storage chamber 7 via the self-holding air introduction port 138. This compressed air acts on the left end surface of the piston 126 to drive the safety piston 123 toward the bottom dead center, i.e. to the right as viewed in FIG. 12. In this state, however, the lock mechanism 124 is operating so that the safety piston 123 is still held at the top dead center. Namely, the safety system is still in operating condition.

For starting the nail driving work after the completion of the preparation, the unlocking stem 137 of the lock mechanism 124 is depressed toward the bottom dead center overcoming the force of the coiled compression spring 136. By so doing, the opening lower edge 133*b* of the lock plunger 134 is disengaged from the reduced diameter portion 129 of the safety piston, so that the compressed air supplied through the self holding air introduction port 138 acts to drive the safety piston 123 toward the bottom dead center and hold the same at that position.

After the completion of the nail driving work, the compressed air in the compressed air storage chamber 7 is instantaneously released to the atmosphere as the compressed air storage chamber 7 is disconnected from the compressed air source. As a result, the compressed air in the safety cylinder 122 is also released to the atmosphere through the self-holding air introduction port 138 and the compressed air storage chamber 7. In consequence, the safety piston 123 is moved toward the top dead center by the resetting force of the coiled compression spring 127, so that the lock stem 125 contacts the upper face 10*c* of the head valve piston 10 to hold the latter at the bottom dead center.

The resting of the safety piston 123 at the top dead center causes the lock mechanism 124 to operate so that the opening lower edge 133*b* of the retaining opening 133 comes into engagement with the reduced diameter portion 129 by the spring force of the coiled compression spring 136. In consequence, the safety piston 123 is automatically locked at the safety operation position.

Figure 13:
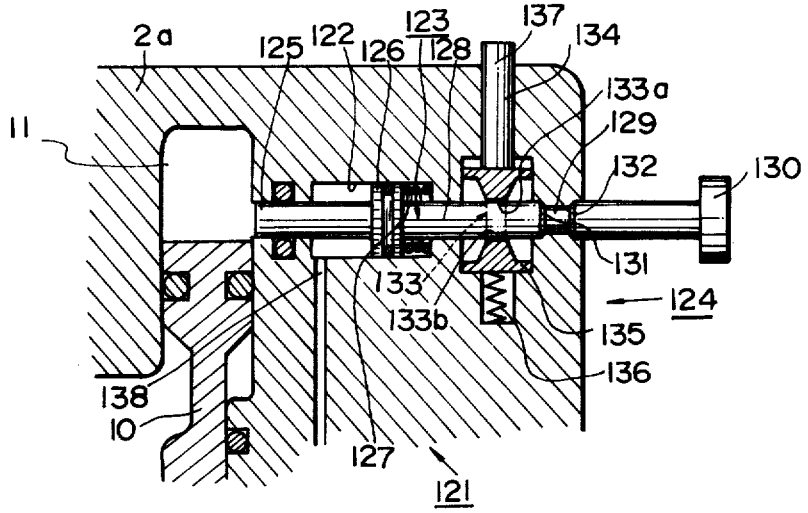
FIG. 13 is a longitudinal sectional view of the same safety cylinder device as shown in FIG. 12, in the inoperative state of the safety system.

For turning the safety system operative without disconnecting the compressed air storage chamber 7 from the compressed air source, the knob 130 is urged to drive the safety piston 123 toward the top dead center in the state shown in FIG. 13. By so doing, the lock mechanism 124 is automatically turned into operative state when the safety piston 123 reaches the top dead center.

We claim:

1. In a safety system incorporated in a pneumatic impact tool, the tool having an impact cylinder accomodating an impact piston to which rigidly connected is a driver for directly impacting a fastener, said impact piston defining in said impact cylinder an upper chamber of the impact cylinder at the same side as the top dead center of said impact piston; a compressed air storage chamber adapted to be charged with compressed air when it is connected to a compressed air source and to discharge the same when it is disconnected from the compressed air source; a differential pressure type head valve having a head valve cylinder and a head valve piston accomodated by the latter, said head valve piston being adapted to interrupt, when it takes the bottom dead center, a communication between said upper chamber of the impact cylinder and said compressed air storage chamber, and to establish said communication when it moves from said bottom dead center to the top dead center; and a control air passage interconnecting said compressed air storage chamber and a control chamber of said head valve, said control air passage having a manual trigger valve adapted to change the air pressure in said control air passage to cause a movement of said head valve piston between said top and bottom dead centers;

the improvement comprising: a first control air passage and a second control air passage constituting said control air passage, said first control air passage always communicating with said control chamber, said second control passage having said trigger valve and adapted to be communicated with said compressed air storage chamber when said trigger valve 15 is not manually operated; and a self-holding type safety valve having a safety valve cylinder (13, 56 or 73) accomodating a valve spring (42, 65*a* or 100) and a safety valve piston (27, 57 or 74) provided with a manually operable stem (34, 68*a* or 88), said safety valve (25, 55 or 72) having a mis-discharge prevention air introduction port (32, 60 or 77) always communicating with said compressed air storage chamber (7) and adapted to prevent mis-discharge of said impact piston (4), a first connection port (31, 59 or 77) always communicating with said first control air passage (12), and a second connection port (30, 58 or 75) always communicating with said second control air passage (14), wherein, when said compressed air storage chamber (7) is disconnected from said compressed air source, said safety valve piston (27, 57 or 74) is moved, by the resetting force of said valve spring (42, 65*a* or 100), to the operative position of said safety system in which said mis-discharge prevention air introduction port (32, 60 or 77) is communicated with said first connection port (31, 59 or 76) and, at the same time, said first connection port (31, 59 or 76) is interrupted in communication with said second connection port (30, 58 or 75), and, also when said compressed air storage chamber (7) is brought into connection with said compressed air source, safety valve piston (27, 57 or 74) is still maintained at said operative position of safety system, due to the differential force between the resetting force of said valve spring (42, 65*a* or 100) and the total pressure of compressed air introduced into said safety valve cylinder (13, 56 or 73) through said mis-discharge prevention air introduction port (32, 60 or 77) and through said second connection port (30, 58 or 75) to act on said safety valve piston (25, 57 or 74) and further, when said manually operable stem (34, 68*a* or 88) is operated, said safety valve piston (27, 57 or 74) is moved to and self-held at inoperative position of said safety system in which the communication between said mis-discharge prevention air introduction port (32, 60 or 88) and said first connection port (31, 59 or 76) is interrupted and the communication between said first connection port (31, 59 or 76) and said second connection port (30, 58 or 75) is completed.

2. A safety system as claimed in claim 1, wherein said manually operable stem (34) has a reduced diameter portion (45) for locking purpose defined by shoulders (46 and 47), said manually operable stem (34) being adapted to be engaged by a lock mechanism (43) including a lock cylinder (29), a lock piston (49) accomodated by said lock cylinder (29) and slidable in the transverse direction of said manually operable stem (34), a manually operable unlocking stem (54) rigidly connected to said lock piston (49) and a spring 54*a* adapted to bias said lock piston (49) either to the top or bottom dead center of the lock piston (49), said lock piston (49) having a retaining opening (48) adapted to freely pass said manually operable stem (34) and having a diameter slightly greater than that of said manually operable stem (34), said lock cylinder (29) having a self-holding air introduction port (33) always communicating with said compressed air storage chamber (7) and adapted to supply compressed air acting in the direction opposite to the biasing force of said spring (54*a*), whereby, when said safety valve piston (27) takes said inoperative position of said safety system, said lock piston (49) is moved, by the compressed air introduced into said lock cylinder (29) through said self-holding air introduction port (33), overcoming the force of said spring (54*a*) of said lock mechanism (43), thereby to bring the opening lower edge (52) or the opening upper edge (51) of said retaining opening (48) into engagement with said reduced diameter portion (45) thereby to lock said safety valve piston (27) at the inoperative position of said safety system, while, when said compressed air storage chamber (7) is disconnected from said compressed air source, said opening lower edge (52) or opening upper edge (51) of said retaining opening (48) is disengaged from said reduced diameter portion (45) due to the resetting force of said spring (54*a*) of said lock mechanism (43).

3. A safety system as claimed in claim 1, wherein said safety valve piston (57) has a large diameter piston (65) and a small diameter piston (64) interconnected and spaced at a certain distance by a connecting stem (68), and "O" ring (69) being fitted to the side (65*b*) of said large diameter piston (65) confronting the top dead center of said safety valve piston (57), said safety valve cylinder (56) being provided at its intermediate portion with an intermediate valve seat (61) having one surface (61*a*) confronting the top dead center of said safety valve piston (57) and the other surface (61*b*) confronting the bottom dead center of the same, said large diameter piston (65) and said "O" ring (69) being positioned at the same side as said other side (61*b*) of said intermediate valve seat (61), said small diameter piston (64), said mis-discharge prevention air introduction port (60), said first connection port (59) and said second connection port (58) being positioned at the same side as said one surface (61*a*) of said intermediate valve seat (61), said "O" ring (69) being adapted to be brought into and out of contact with said other side (61*b*) of said valve seat (61) in accordance with the movement of said safety valve piston (57).

4. A safety valve system as claimed in claim 1, wherein said safety valve piston (74) has a large diameter piston (83) adapted to divide the space in said safety valve cylinder (73), said manually operable stem (88) having a small diameter stem (88*a*) connected at its one end to said large diameter piston (83) and a large diameter stem (88*b*) connected to the other end of said small diameter stem (88*a*), said safety valve cylinder (73) further having an opening (89) adapted to be communicated with or incommunicative to the atmosphere in accordance with the movement of said manually operable stem (88) in said opening (89), and a self-holding air introduction port (78), an "O" ring (90) being fitted to the inner wall of said opening (89), said "O" ring (190) being adapted to cooperate with said manually operable stem (80) in establishing and interrupting communication between the atmosphere and a top chamber (98*a*) which is defined by said large diameter piston (73) and positioned at the same side as the top dead center of said safety valve piston (74) corresponding to said operative position of said safety system, whereby, when said safety valve piston (74) is in said inoperative position of said safety system, said top chamber (98*a*) is sealed against the atmosphere due to mutual engagement of said "O" ring (90) and said large diameter stem (88*b*), so that compressed air supplied through said self-holding air introduction port (78) to said top chamber (98*a*) acts to hold said safety valve piston (74) in said inoperative position of said safety system overcoming the force which is the sum of the force of compressed air supplied through said first connection port (76), mis-discharge prevention air introduction port (77) and second connection port (75), and the force of said valve spring (96).

5. A safety system as claimed in claim 4, wherein an exhaust valve (80) is disposed between the atmosphere and said top chamber (98*a*), said exhaust valve (80) being adapted to be operated manually independently of said opening (89) to establish the communication between said top chamber (98*a*) and the atmosphere, the amount of air discharged to the atmosphere through said exhaust valve (80) being set to be greater than that of compressed air supplied to said top chamber (98*a*) through said self-holding air introduction port (78), and wherein, when said top chamber (98*a*) is brought into communication with the atmosphere through said exhaust valve (80), said safety valve piston (83) commences its movement to said operative position of said safety system due to a pressure drop in said top chamber (98*a*), the movement of said safety valve piston (83) being continued because of the disengagement of said large diameter stem (88*b*) from said "O" ring (90), said safety valve piston (83) then being held at said operative position of said safety system because of the force of compressed air supplied into said safety valve cylinder (73) via said mis-discharge prevention air introduction port (77) and the force of said valve spring (96) acting on the safety valve piston (83).

6. In a safety system incorporated in a pneumatic impact tool, the tool having an impact cylinder accomodating an impact piston to which rigidly connected is a driver for directly impacting a fastener, said impact piston defining in said impact cylinder an upper chamber of the impact cylinder at the same side as the top dead center of said impact piston; a compressed air storage chamber adapted to be charged with compressed air when it is connected to a compressed air source and to discharge the same when it is disconnected from said compressed air source; a differential pressure type head valve having a head valve cylinder and a head valve piston accomodated by the latter, said head valve piston being adapted to interrupt, when it takes the bottom dead center, a communication between said upper chamber of the impact cylinder and said compressed air storage chamber, and to establish said communication when it moves from said bottom dead center to the top dead center; and a control air passage interconnecting said compressed air storage chamber and a control chamber of said head valve, said control air passage having a manual trigger valve adapted to change the air pressure in said control air passage to cause a movement of said head valve piston between said top and bottom dead centers;

the improvement comprising: a safety cylinder device (101 or 121) disposed in the vicinity of said head valve (8), said safety cylinder device (101 or 121) including a safety cylinder (102 or 122) and a safety plunger (103) or safety piston (123) accomodated by said safety cylinder (102 or 122), said safety plunger (103) or safety piston (123) having a lock stem (105 or 125) which can move into and out of said control chamber (11) and adapted to make contact with the top face (10*c*) of said head valve piston (10) resting at the bottom dead center thereby to prevent said head valve piston (10) from moving toward the top dead center, as well as a manually operable stem (107 or 128), said safety cylinder device (101 or 121) further including a spring (120 or 127) adapted to reset said safety plunger (103) or said safety piston (123) to the operative position of said safety system in which said lock stem (105 or 125) is projected into said control chamber (11), and a self-holding air introduction port (115 or 138) for supplying compressed air for holding said safety plunger (103) or safety piston (123) at said inoperative position of said safety system in which said lock stem (105 or 125) is retracted from said control chamber (11), said self-holding air introduction port (115 or 138) being always communicated with said compressed air storage chamber (7); whereby, when said compressed air storage chamber (7) is disconnected from said compressed air source, said safety plunger (103) or said safety piston (123) is moved to said inoperative position of said safety system due to the resetting force of said spring (120 or 127), while, when said compression air storage chamber (7) is connected to said compressed air source, said safety plunger (103) or said safety piston (123) is still held at said operative position of said safety system due to the resetting force of said spring (120 or 127) and further, when said safety plunger (103) or said safety piston (123) is moved to said operative position of said safety system by means of said manually operable stem (107 or 128), said safety plunger (103) or said safety piston (123) is maintained at said operative position by the force of compressed air supplied through said self-holding air introduction port (115 of 138).

7. A safety system as claimed in claim 6, wherein said manually operable stem (107) is provided with a reduced diameter portion (108) for locking purpose demarked from other portion by both shoulders (110 and 111), said manually operable stem (107) being adapted to be engaged by a lock mechanism (104) including a lock cylinder (116), lock piston (113) accomodated by said lock cylinder (116) and slidable transversely of said manually operable stem (107), manually operable unlocking stem (118) rigidly connected to said lock piston (113) and a spring (119) adapted to bias said lock piston (113) toward either the bottom or top dead center of said lock piston (113), said lock piston (113) being provided with a retaining opening (112) adapted to freely pass said manually operable stem (107) and said retaining opening (112) having a diameter slightly larger than that of said lock piston (113), said self-holding air introduction port (115) being provided in said lock cylinder (113) so as to apply said compressed air to said lock piston (113) in the direction opposite to the force of said spring (119) of said lock mechanism (104), whereby, when said safety piston (123) is held stationary at said inoperative position of the safety system, said lock piston (113) is moved by the compressed air supplied to said lock cylinder (116), through said self-holding air introduction port (115) overcoming the resetting force of said spring (119) of said lock mechanism (104) thereby to bring the opening lower edge (112*b*) or opening upper edge (112*a*) of said retaining opening (112) into engagement with said reduced diameter portion (108) to lock said safety piston (123) in said inoperative position of said safety system, and, when said compressed air storage chamber (7) is disconnected from said compressed air source, said opening lower edge (112*b*) or opening upper edge (112*a*) of said retaining opening (112) is disengaged from said reduced diameter portion (108) due to the resetting force of said spring (119) of said lock mechanism (104).

8. A safety system as claimed in claim 6, wherein said manually operable stem (128) is provided with a reduced diameter portion (129) for locking purpose demarked from other portions of said manually operable stem (128) by both shoulders (131 and 132), said manually operable stem (128) being adapted to be engaged by a lock mechanism (124) including a lock cylinder (116), a lock plunger (134) accomodated by said lock cylinder (116) and slidable in the transverse direction of said manually operable stem (128) and a spring (136) adapted to bias said lock plunger (134) either toward the bottom or top dead center, said lock plunger (134) having a retaining opening (133) adapted to be freely pass said manually operable stem (128) and said retaining opening (133) having a diameter somewhat greater than that of said manually operable stem (128), said self-holding air introduction port (138) being formed in said safety cylinder (122) so as to apply a force to said safety piston (123) in the direction opposite to the force of said spring (127) in said safety cylinder (122), whereby, when said safety piston (123) is in the inoperative position of said safety system, the compressed air supplied into said safety cylinder (122) through said self-holding air introduction port (138) holds said safety piston (123) in said inoperative position of said safety system, overcoming the resetting force of said spring (127) in said safety cylinder (122), so that, when said compressed air storage chamber (7) is disconnected from said compressed air source, the opeing lower edge (112*b*) or opening upper edge (112*a*) of said retaining opening (133) is brought into engagement with said reduced diameter portion (129) by the resetting force to said spring (127 and 136).

* * * * *